US007087863B1

(12) United States Patent
Kim et al.

(10) Patent No.: US 7,087,863 B1
(45) Date of Patent: Aug. 8, 2006

(54) OVEN

(75) Inventors: Cheol Jin Kim, Suwon-Si (KR); Yun Ic Hwang, Suwon-Si (KR); Seok Weon Hong, Yongin-Si (KR); Pung Yeun Cho, Suwon-Si (KR); Yu Jeub Ha, Suwon-Si (KR); Kyoung Ho Kim, Suwon-Si (KR); Sung Kwang Kim, Ansan-Si (KR); Kil Young Lee, Suwon-Si (KR); Sung Soo Park, Hwaseong-Si (KR); Tae Ho Kim, Hwaseong-Si (KR); Sang Hyun Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/285,078

(22) Filed: Nov. 23, 2005

(30) Foreign Application Priority Data

Jun. 8, 2005 (KR) ..... 10-2005-0048925

(51) Int. Cl.
*F24C 15/16* (2006.01)
*A21B 3/00* (2006.01)

(52) U.S. Cl. ..... 219/394; 126/333

(58) Field of Classification Search ..... 219/394
See application file for complete search history.

(56) References Cited

U.S. PATENT DOCUMENTS

| | | | | |
|---|---|---|---|---|
| 1,657,205 | A * | 1/1928 | Ehrgott | 219/400 |
| 2,994,760 | A * | 8/1961 | Pecoraro et al. | 219/394 |
| 5,618,458 | A * | 4/1997 | Thomas | 219/394 |
| 6,545,251 | B1 * | 4/2003 | Allera et al. | 219/394 |

FOREIGN PATENT DOCUMENTS

| | | |
|---|---|---|
| JP | 62-52328 | 3/1987 |
| JP | 63-172837 | 7/1988 |
| KR | 2002-57146 | 7/2002 |

* cited by examiner

*Primary Examiner*—Joseph Pelham
(74) *Attorney, Agent, or Firm*—Staas & Halsey LLP

(57) ABSTRACT

An oven capable of preventing heat transfer from one cooking space having relatively high temperature to another cooking space having relatively low temperature along each side plate of a cooking chamber having a plurality of partitioned cooking spaces. The oven includes an insulating unit and a cooling unit mounted at each side plate to prevent heat transfer between first and second cooking spaces along each side plate. The insulating unit includes a slit formed right under the partition, an insulating member fitted in the slit, and a supporting member attached to the inside of each side plate. The cooling unit includes an air guide member attached to the outside of each side plate to cover the insulating member, and a blowing fan connected to the air guide member to forcibly blow outside air to the air guide member.

17 Claims, 7 Drawing Sheets

OVEN

CROSS-REFERENCE TO RELATED APPLICATIONS

This application claims the benefit of Korean Patent Application No. 2005-48925, filed on Jun. 8, 2005 in the Korean Intellectual Property Office, the disclosure of which is incorporated herein by reference.

BACKGROUND OF THE INVENTION

1. Field of the Invention

The present invention relates to an oven, and, more particularly, to an oven that is capable of preventing heat transfer from one cooking space having relatively high temperature to another cooking space having relatively low temperature along opposite side plates of a cooking chamber. The cooking chamber includes a plurality of vertically partitioned cooking spaces by the provision of insulating units and cooling units, which are mounted at the opposite side plates of the cooking chamber.

2. Description of the Related Art

Conventional ovens are classified into different types, such as a microwave oven to cook food using microwaves, an electric oven to cook food using an electric heater, and a gas oven to cook food using gas heat. Each oven includes a plurality of partitions vertically mounted in a cooking chamber, which is partitioned into a plurality of cooking spaces by the partitions, whereby several kinds of food are simultaneously cooked.

An example of conventional ovens each having a plurality of cooking spaces vertically partitioned by a plurality of partitions is disclosed in Japanese Unexamined Patent Publication No. S63-172837.

The conventional oven includes a plurality of supporting rails vertically mounted at opposite side plates of a cooking chamber thereof, and a plurality of partitions are connected to the corresponding supporting rails to partition the cooking chamber into a plurality of cooking spaces such that several kinds of food can be simultaneously cooked or the volumes of the cooking spaces can be changed based on the size and kind of the food.

In the conventional oven with the above-stated construction, however, heat transfer is carried out along the opposite side plates of the cooking chamber. As a result, heat is transferred from one cooking space where food is cooked to another cooking space where food is not cooked along the opposite side plates of the cooking chamber. When food is cooked in all the cooking spaces, heat is transferred from one cooking space having relatively high temperature to another cooking chamber having relatively low temperature along the opposite side plates of the cooking chamber.

As the heat transfer is carried out between the cooking spaces along the opposite side plates of the cooking chamber as described above, heat loss is generated, and therefore, energy consumption is increased. Furthermore, the temperature of the cooking space where the food is not cooked is increased due to heat transferred from the cooking space where the food is cooked along the opposite side plates of the cooking chamber. Further, the door of the oven is maintained at high temperature thereby making it unsafe for a user to touch the door after cooking is completed.

SUMMARY OF THE INVENTION

Accordingly, it is an aspect of the invention to provide an oven including a cooking chamber having a plurality of vertically partitioned cooking spaces, that is capable of preventing heat transfer from one cooking space having relatively high temperature to another cooking space having relatively low temperature along opposite side plates of the cooking chamber.

Additional aspects and/or advantages of the invention will be set forth in part in the description which follows and, in part, will be apparent from the description, or may be learned by practice of the invention.

The foregoing and/or other aspects of the present invention are achieved by providing an oven including a cooking chamber, a partition horizontally disposed in the cooking chamber to partition the cooking chamber into first and second cooking spaces; and an insulating unit mounted at each side plate of the cooking chamber to prevent heat transfer between the first and second cooking spaces along each side plate of the cooking chamber.

The insulating unit includes a slit having a predetermined width, formed along each side plate of the cooking chamber under the partition, an insulating member fitted in the slit to prevent heat transfer along each side plate, and a supporting member attached to an inside of each side plate to support the insulating member.

The supporting member includes a receiving part to receive the insulating member, and upper and lower flange parts vertically extending from the upper and lower ends of the receiving part, respectively, such that the upper and lower flange parts are attached to each side plate of the cooking chamber.

The insulating member includes upper and lower flange parts vertically extending from the upper and lower ends thereof, respectively, wherein the upper and lower flange parts of the insulating member are attached to each side plate of the cooking chamber along with the upper and lower flange parts of the supporting member.

The oven further includes a cooling unit mounted at the outside of each side plate of the cooking chamber to cool the insulating member.

The cooling unit includes an air guide member attached to an outside of each side plate of the cooking chamber to cover the insulating member; and a blowing fan connected to the air guide member to forcibly blow outside air to the air guide member.

The air guide member includes a channel part forming an air passage, and upper and lower flange parts vertically extending from the upper and lower ends of the channel part, respectively, such that the upper and lower flange parts are attached to the outside of each side plate.

The channel part includes a plurality of pushing protrusions to push the insulating member to the supporting member such that the insulating member is prevented from being moved in the receiving part of the supporting member.

The blowing fan is mounted on top of the cooking chamber at an outside of the cooking chamber, and the air guide member includes one end connected with the blowing fan through a connection duct such that air blown by the blowing fan is supplied to the air guide member.

The supporting member and the air guide member are made of a material having high heat resistance and low heat conductivity.

It is another aspect of the present invention to provide an oven including a cooking chamber, a partition horizontally disposed in the cooking chamber to partition the cooking chamber into first and second cooking spaces, and a cooling unit mounted at each side plate of the cooking chamber to minimize heat transfer between the first and second cooking spaces along each side plate of the cooking chamber.

Each side plate includes a slit having a predetermined width, formed along each side plate under the partition, and the cooling unit includes an air guide member to cover the slit at the outside of each side plate, a cover plate to cover the slit at the inside of each side plate, a blowing fan mounted on top of the cooking chamber at the outside of the cooking chamber to forcibly blow outside air to the air guide member, and a connection duct connected between the blowing fan and the air guide member.

The air guide member includes a channel part forming an air passage, and upper and lower flange parts vertically extending from the upper and lower ends of the channel part, respectively, such that the upper and lower flange parts are attached to the outside of each side plate.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
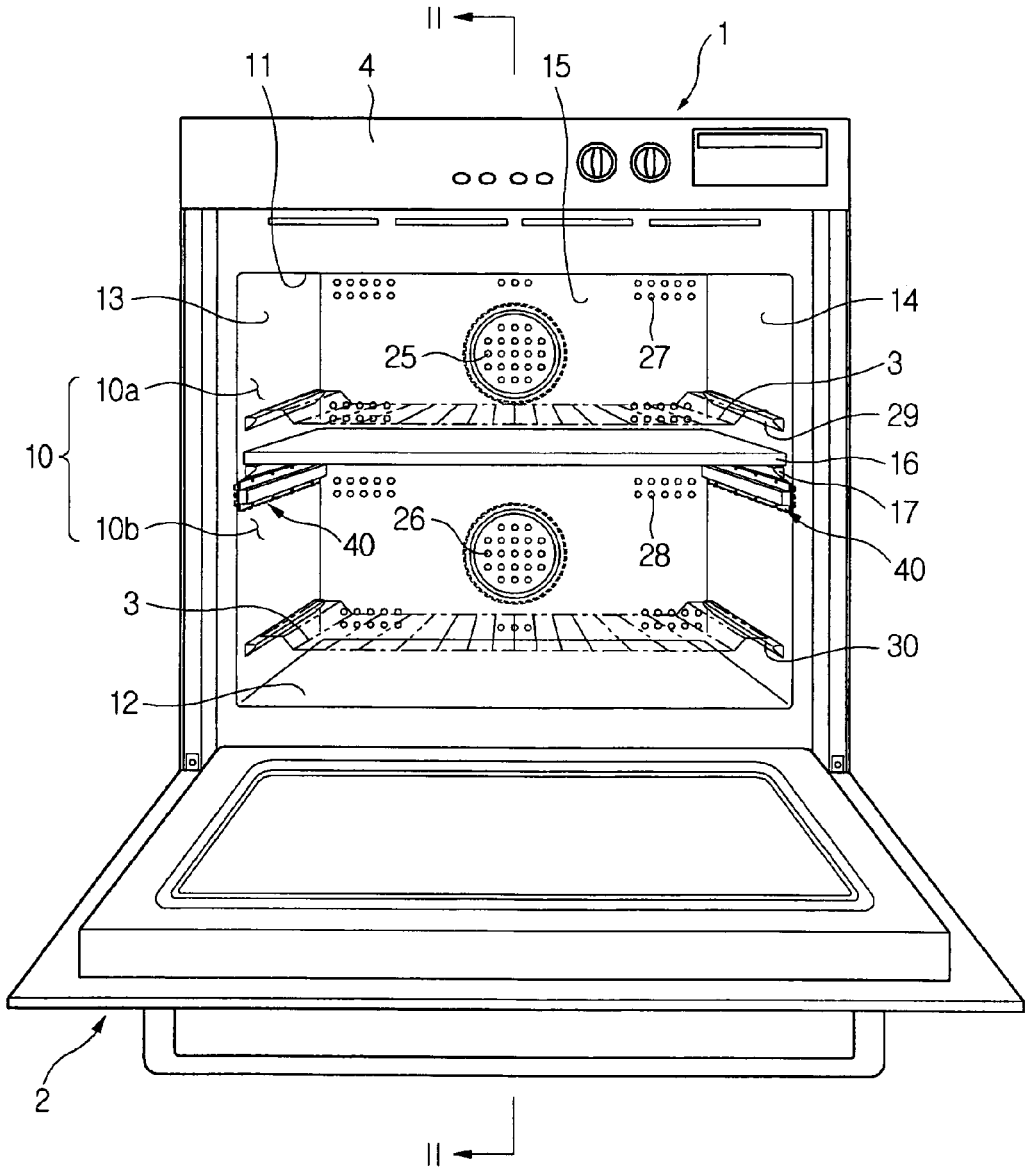
FIG. 1 is a front view schematically illustrating an oven according to the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 2:
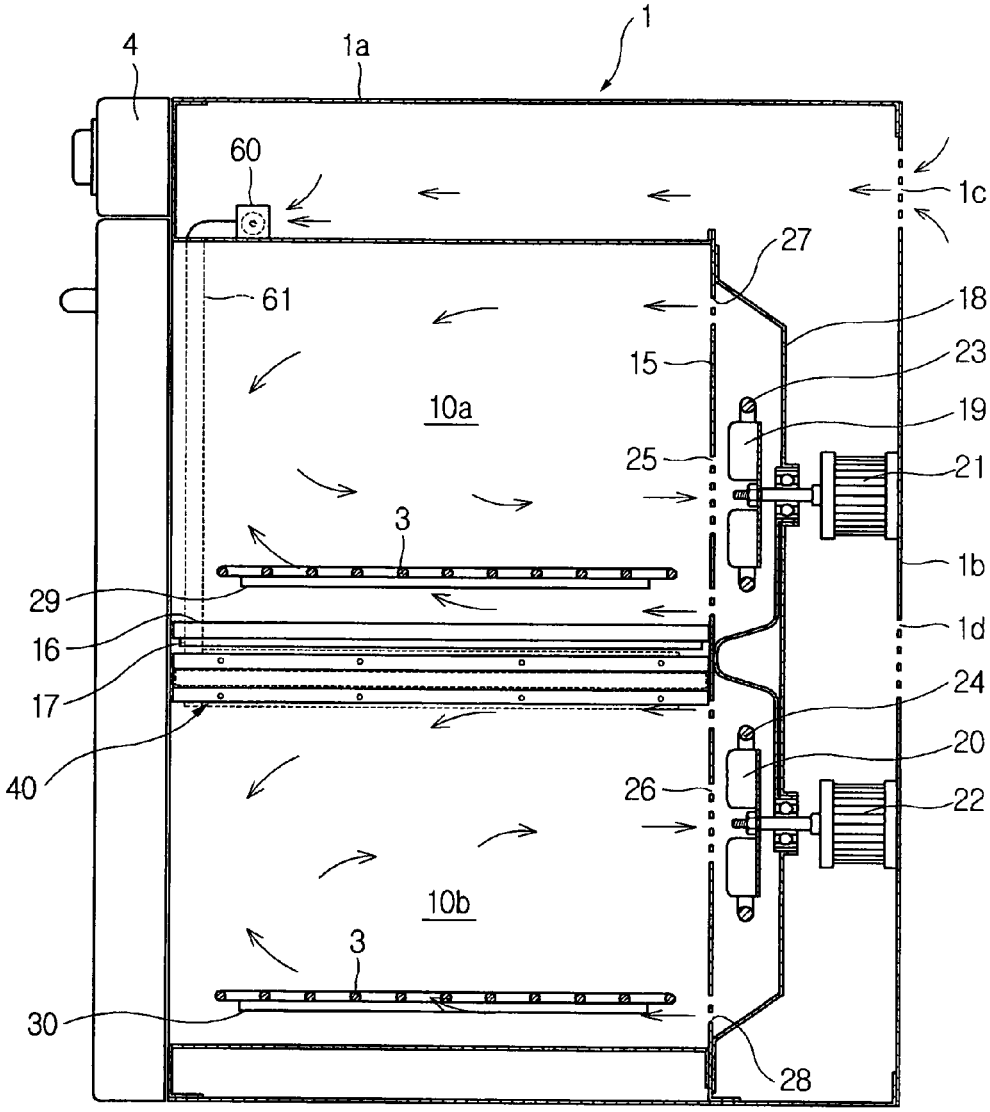
FIG. 2 is a sectional view taken along line II—II of FIG. 1.

FIG. 1 is a front view schematically illustrating the structure of an oven according to the present invention, and FIG. 2 is a sectional view taken along line II—II of FIG. 1.

As shown in FIGS. 1 and 2, the oven comprises a cabinet 1, formed of a box-shape having an opened front surface, including a cooking chamber 10 defined therein, and a door 2 hingedly connected with a lower end of the cabinet 1, to open and close the opened front surface of the cabinet 1. The cabinet 1 and the door 2 together form an outer appearance of the oven.

The cooking chamber 10 comprises a top plate 11, a bottom plate 12, a left side plate 13, a right side plate 14, and a rear plate 15. Consequently, the front surface of the cooking chamber 10 is opened. The top plate 11 and the rear plate 15 are spaced predetermined distances from a top plate 1*a* and a rear plate 1*b* of the cabinet 1, respectively.

The cooking chamber 10 is partitioned into a first cooking space 10*a* and a second cooking space 10*b* by a partition 16 disposed in the cooking chamber 10 to vertically partition the cooking chamber 10 such that different kinds of food are simultaneously cooked in the first cooking space 10*a* and the second cooking space 10*b*, or food is cooked in the first cooking spaces 10*a* or the second cooling space 10*b*.

The partition 16 includes a heat-insulating structure to prevent heat transfer between the first cooking space 10*a* and the second cooking space 10*b*. At the left side plate 13 and the right side plate 14 are formed supporting protrusions 17, by which the partition 16 is supported such that the partition 16 can be easily separated from the cooking chamber 10.

To the outside of the rear plate 15 is attached a fan cover 18. Between the rear plate 15 and the fan cover 18 are mounted a first convection fan 19 to circulate air through the first cooking space 10*a* and a second convection fan 20 to circulate air through the second cooking space 10*b*.

First and second electric heaters 23 and 24 are mounted at the outer circumferences of the first and second convection fans 19 and 20, respectively. Between the fan cover 18 and the rear plate 1*b* of the cabinet 1 are disposed a first drive motor 21, which is connected to the first convection fan 19, and a second drive motor 22, which is connected to the second convection fan 20.

At the upper and lower parts of the rear plate 15, which are opposite to the first and second convection fans 19 and 20, respectively, are formed a plurality of first and second suction holes 25 and 26, respectively. At the edge of the rear plate 15 are formed a plurality of first and second discharge holes 27 and 28.

At the left and right side plates 13 and 14 corresponding to the lower parts of the first and second cooking spaces 10*a* and 10*b* are disposed first and second rails 29 and 30, respectively, such that racks 3 are supported by the first and second rails 29 and 30, respectively. Food to be cooked is placed on the racks 3 in the first and second cooking spaces 10*a* and 10*b*.

To the outsides of the top plate 11, the bottom plate 12, the left and right side plates 13 and 14, by which the cooking chamber 10 is defined, and the fan cover 18 are attached heat-insulating members (not shown) to thermally insulate the cooking chamber 10. At the upper end of the cabinet 1 is mounted a control panel 4 to control a cooking process.

When food is to be cooked in the first cooking space 10*a*, a user puts the rack 3 on the first rails 29 such that the rack 3 is supported by the first rails 29, and places the food to be cooked onto the rack 3, closes the door 2, and manipulates the control panel 4. As the control panel 4 is manipulated, the first electric heater 23 generates heat, and the first convection fan 19 is operated by the first drive motor 21.

As a result, air is suctioned to a space between the rear plate 15 and the fan cover 18 from the first cooking space 10*a* through the first suction hole 25, is heated by the first electric heater 23, and is then discharged into the first cooking space 10*a* through the first discharge hole 27. In this way, the food on the rack 3 disposed in the first cooking space 10*a* is cooked.

When food is to be cooked in the second cooking space 10*b*, the second electric heater 24 generates heat, and the second convection fan 20 is operated by the second drive motor 22. As a result, air in the second cooking space 10*b* is heated to cook the food on the rack 3 disposed in the second cooking space 10*b*.

When food is cooked in the first cooking space 10*a*, heat is transferred from the first cooking space 10*a* to the second cooking space 10*b* along the left and right side plates 13 and 14 of the cooking chamber 10. When food is cooked in the second cooking space 10*b*, heat is transferred from the second cooking space 10*b* to the first cooking space 10*a* along the left and right side plates 13 and 14 of the cooking chamber 10.

When food is cooked in both the first and second cooking spaces 10*a* and 10*b*, heat is transferred from one cooking space having relatively high temperature to the other cooking space along the left and right side plates 13 and 14 of the cooking chamber 10.

In order to prevent heat transfer between the first and second cooking spaces 10*a* and 10*b* along the left and right side plates 13 and 14 of the cooking chamber 10, insulating units 40 and cooling units 50 are mounted at the left and right side plates 13 and 14 of the cooking chamber 10 right under the partition 16, which will be described below in detail with reference to FIGS. 3 to 5.

The insulating unit 40 mounted at the left side plate 13 includes a same structure as the insulating unit 40 mounted at the right side plate 14, and the cooling unit 50 mounted at the left side plate 13 includes a same structure as the cooling unit 50 mounted at the right side plate 14. In the following, therefore, only the construction of the insulating unit 40 and the cooling unit 50 mounted at the left side plate 13 will be described.

Figure 3:
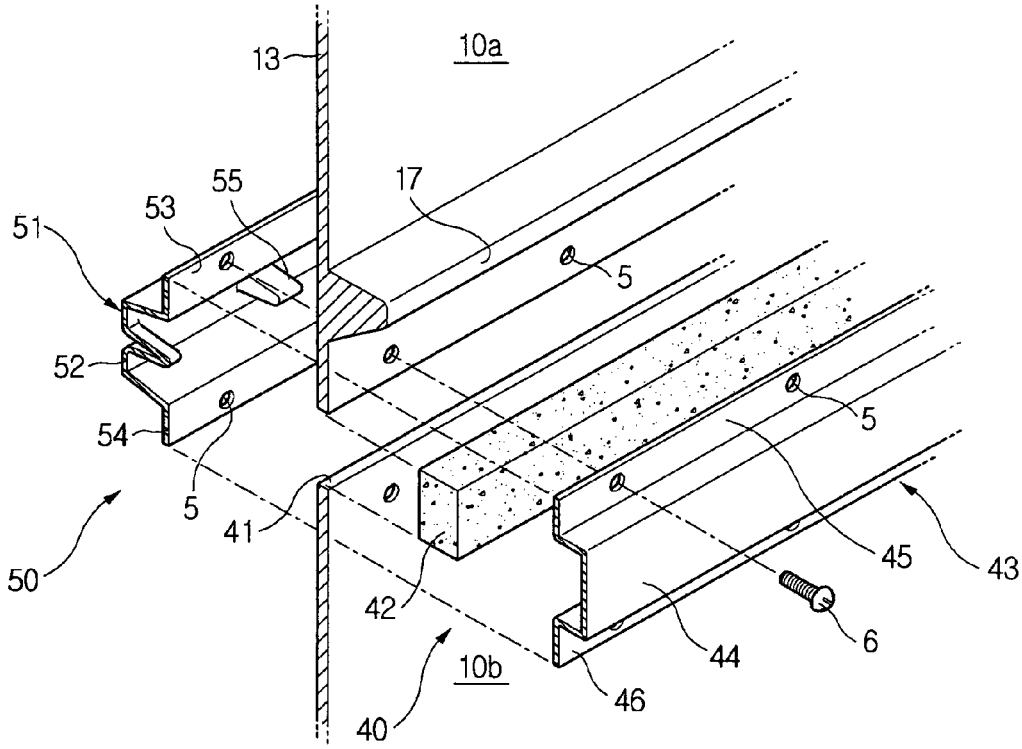
FIG. 3 is an exploded perspective view illustrating an insulating unit and a cooling unit mounted at the left side plate of a cooking chamber in accordance with an embodiment of the present invention.
Figure 4:
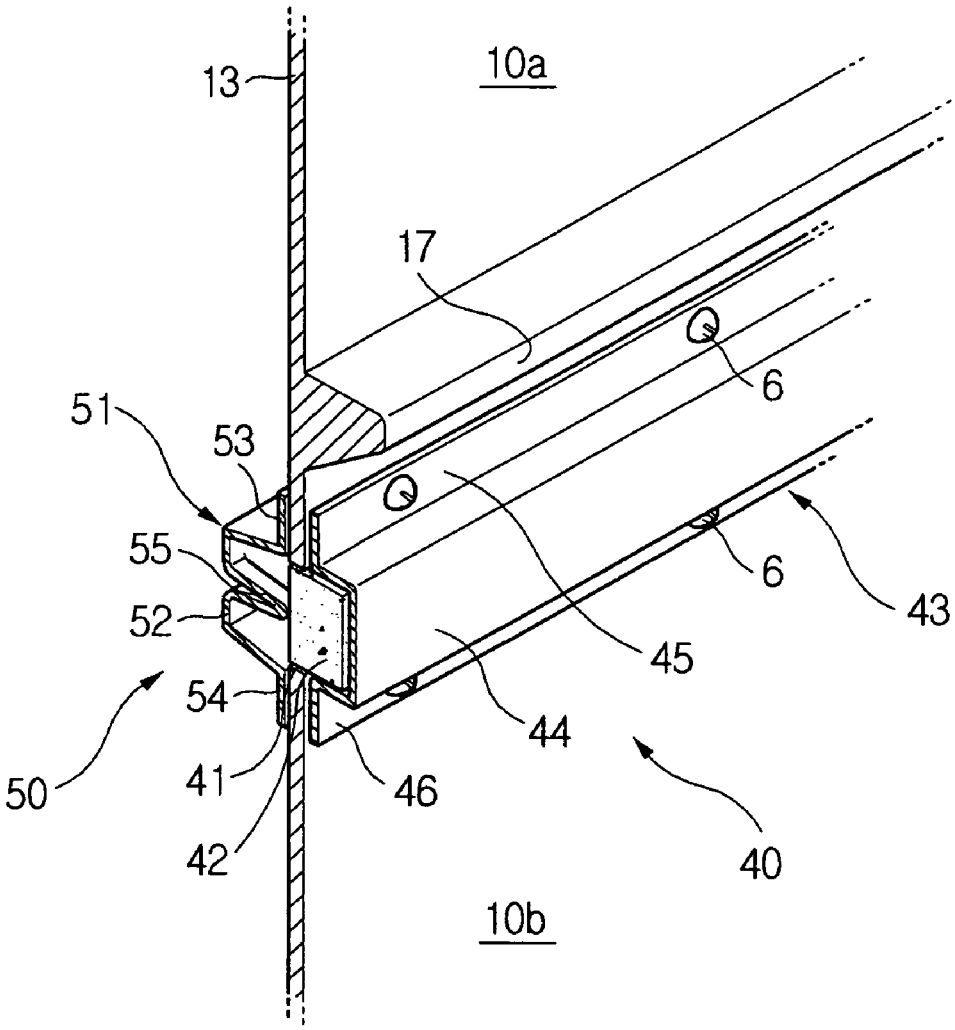
FIG. 4 is a perspective view illustrating an assembly of the insulating unit and the cooling unit of FIG. 3.
Figure 5:
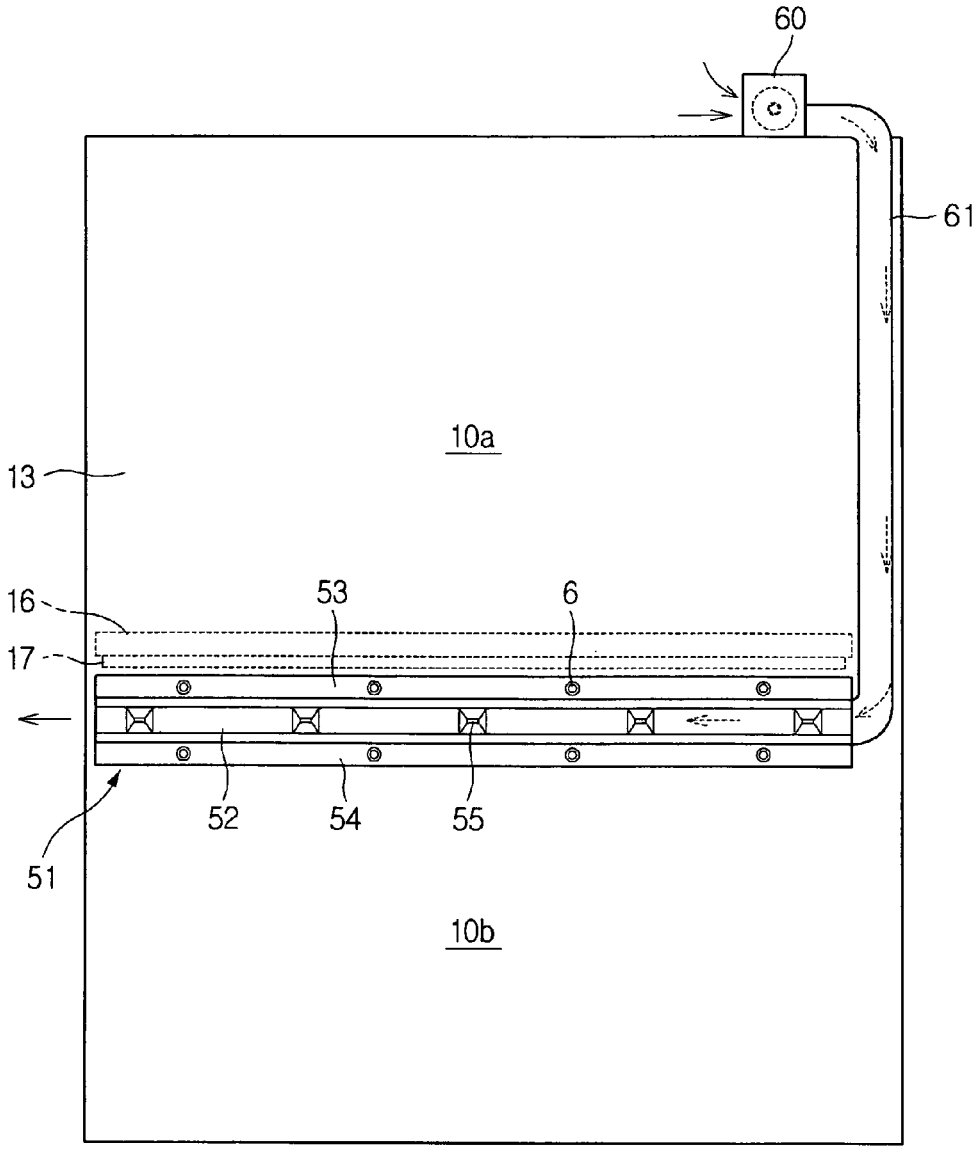
FIG. 5 is a schematic view illustrating air forcibly guided through an air guide member of the cooling unit by a blowing fan of the cooling unit.

FIGS. 3 and 4 are exploded and assembled perspective views, respectively illustrating the insulating unit 40 and the cooling unit 50 mounted at the left side plate 13 of the cooking chamber 10 in accordance with an embodiment of the present invention, and FIG. 5 is a schematic view illustrating air forcibly guided through an air guide member of the cooling unit 50 by a blowing fan of the cooling unit 50.

As shown in FIGS. 3 and 4, the insulating unit 40 and the cooling unit 50 are mounted at the left side plate 13 of the cooking chamber 10 right under the partition 16 and the supporting protrusion 17, by which the partition 16 is supported, to prevent heat transfer between the first and second cooking spaces 10*a* and 10*b* along the left side plate 13 of the cooking chamber 10.

The insulating unit 40 comprises a slit 41 of a predetermined width, horizontally formed between the front and rear ends of the left side plate 13 of the cooking chamber 10, an insulating member 42 fitted in the slit 41, the insulating member 42 having a height corresponding to a width of the slit 41, and a supporting member 43 attached to an inside of the left side plate 13 to surround the insulating member 42 such that the insulating member 42 can be supported by the supporting member 43. Consequently, heat transfer between the first and second cooking spaces 10*a* and 10*b* along the left side plate 13 is prevented by the insulating unit 40.

The supporting member 43 comprises a receiving part 44 formed of a U-shape to receive the insulating member 42, and upper and lower flange parts 45 and 46 integrally formed with the receiving part 44, while vertically extending from the upper and lower ends of the receiving part 44, respectively.

The supporting member 43 is attached to the left side plate 13 of the cooking chamber 10 through thread engagement of screws 6 through screw holes 5 formed at the upper and lower flange parts 45 and 46 at a predetermined interval and screw holes 5 formed at the left side plate 13 above and under the slit 41.

The supporting member 43 is made of a material having high heat resistance and low heat conductivity, such as heat-resistant resin. As an alternative, the insulating member 42 may be constructed such that the upper and lower ends of the insulating member 42 are brought into contact with the upper and lower flange parts 45 and 46 of the supporting member 43, respectively. As a result, the supporting member 43 is connected to the left side plate 13 via the insulating member 42. The supporting member 43 may be made of a metal material, which will be described below with reference to FIG. 6.

The cooling unit 50 is mounted at an outside of the left side plate 13, such that the slit 41 is covered by the cooling unit 50, to cool the insulating member 42 and the supporting member 43. The cooling unit 50 comprises, an air guide member 51 attached to the outside of the left side plate 13 such that an air passage is defined between the air guide member 51 and the slit 41, the air guide member 51 having a sufficient size to cover the slit 41, and a blowing fan 60 (see FIG. 5) connected to the air guide member 51 to forcibly blow outside air to the air guide member 51.

The air guide member 51 comprises a channel part 52 protruded outward from the left side plate 13 by a length slightly greater than the width of the slit 41 such that the air passage is defined between the channel part 52 and the slit 41, and upper and lower flange parts 53 and 54 integrally formed with the channel part 52 while vertically extending from the upper and lower ends of the channel part 52, respectively, such that the upper and lower flange parts 53 and 54 are attached to the outside of the left side plate 13.

At the channel part 52 of the air guide member 51 are formed a plurality of pushing protrusions 55, which are protruded toward the slit 41 to push the insulating member 41 to the receiving part 44 of the supporting member 43 such that the insulating member 42 is prevented from being moved.

The air guide member 41 is made of a material having high heat resistance and low heat conductivity similar to that of the supporting member 43. The air guide member 41 is attached to the outside of the left side plate 13 through thread engagement of screws 6 through screw holes 5 formed at the upper and lower flange parts 53 and 54 at a predetermined interval, which are aligned with the screw holes 5 formed at the upper and lower flange parts 45 and 46 of the supporting member 43.

As shown in FIG. 5, the blowing fan 60 of the cooling unit 50 is mounted on the top plate 11 of the cooking chamber 10, and is connected to the inlet of the channel part 52 of the air guide member 51 to forcibly blow air to the air guide member 51.

At the rear plate 1*b* of the cabinet 1 are formed through-holes 1*c*, through which outside air is suctioned into the cabinet 1 by the blowing fan 60, and through-holes 1*d*, through which air flowing through the air guide member 51 is discharged out of the cabinet 1 (see FIG. 2).

The supporting member 43 is placed at the inside of the cooking chamber 10 such that the screw holes 5 of the supporting member 43 are aligned with the screw holes 5 formed at the left side plate 13 above and under the slit 41, respectively. The insulating member 42 is fitted into the receiving part 44 of the supporting member 43 through the slit 41. The air guide member 51 is placed at the outside of the cooking chamber 10 such that the screw holes 5 of the air guide member 51 are aligned with the screw holes 5 of the supporting member 43, respectively. In this state, screws 6 are threadedly engaged into the screw holes 5 from the inside of the cooking chamber 10 such that the supporting member 43 and the air guide member 51 are securely attached to the inside and the outside of the left side plate 13 about the slit 41 while the insulating member 42 is brought into contact with the supporting member 43 by the pushing protrusions 55 of the air guide member 51.

Subsequently, the blowing fan 60 mounted on the top plate 11 of the cooking chamber 10 is connected to the air guide member 51 mounted at the outside of the left side plate 13 through a connection duct 61. In this way, the assembly of the insulating unit 40 and the cooling unit 50 is completed.

It should be noted that the insulating unit 40 and the cooling unit 50 are also attached to the right side plate 14 of the cooking chamber 10 in the same manner.

When food is cooked in the first cooking space 10*a* or the second cooking space 10*b*, or when food is cooked in both the first and second cooking spaces 10*a* and 10*b*, heat transfer between the first and second cooking spaces 10*a* and 10*b* along the left and right side plates 13 and 14 is prevented by the insulating members 42 fitted in the slits 41, respectively. Furthermore, outside air is forcibly blown to the insulating members 42 and the supporting member 43 through the channel part 52 of the air guide member 51 by the blowing fan 60 such that the insulating members 42 and the supporting member 43 are cooled by the outside air. Consequently, the food is cooked in the optimum cooking condition in the first cooking space 10*a* and/or the second cooking space 10*b*.

The air flowing through the air guide member 51 merely serves to prevent increase in temperature of the insulating members 42 and the supporting members 43, and therefore, the interior temperature of the cooking chamber 10 is not decreased by the air flowing through the air guide member 51.

In the illustrated embodiment, the slit 41 is formed at the left side plate 13 under the partition 16 and the supporting protrusion 17 such that the insulating unit 40 and the air guide member 51 of the cooling unit 50 are disposed at a side of the second cooking space 10*b*. As an alternative, the slit 41 may be formed at the left side plate 13 *t* above the partition 16 and the supporting protrusion 17, or two slits 41 may be formed, one of the slits 41 formed at the left side plate 13 under the partition 16 and the supporting protrusion 17 and the other slit 41 formed above the partition 16 and the supporting protrusion 17

Figure 6:
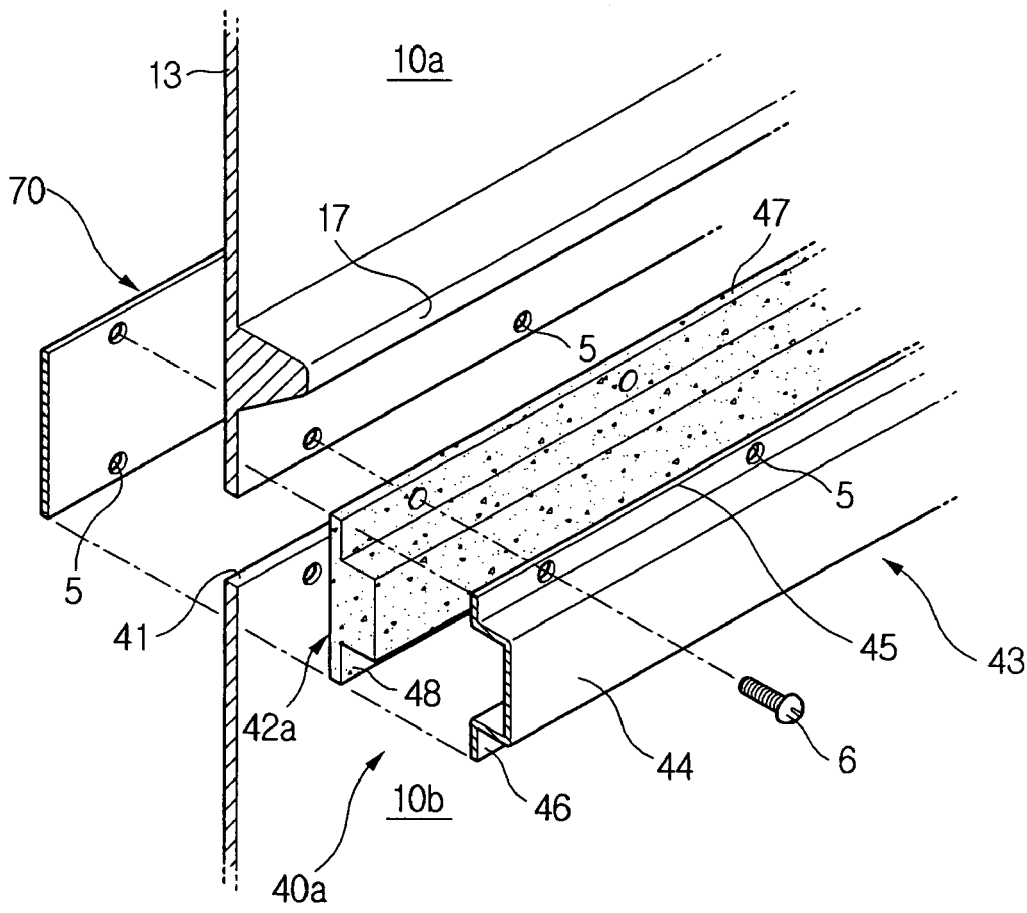
FIG. 6 is an exploded perspective view illustrating an insulating unit mounted at the left side plate of the cooking chamber in accordance with another embodiment of the present invention.

FIG. 6 is an exploded perspective view illustrating an insulating unit 40*a* mounted at the left side plate 13 of the cooking chamber 10 in accordance with another embodiment of the present invention. As shown in FIG. 6, no cooling unit is mounted at an outside of the left side plate 13 of the cooking chamber 10, and therefore, heat transfer between the first and second cooking spaces 10*a* and 10*b* along the left side plate 13 of the cooking chamber 10 is prevented only by the insulating unit 40*a*.

The insulating unit 40*a* comprises a slit 41, a supporting member 43 attached to the inside of the left side plate 13, an insulating member 42*a* supported by the supporting member 43 at the inside of the left side plate 13, and a cover plate 70 to cover the slit 41 at the outside of the left side plate 13.

The supporting member 43 comprises, a receiving part 44 to receive the insulating member 42*a*, and upper and lower flange parts 45 and 46 formed at the upper and lower ends of the receiving part 44, respectively, the upper and lower flange parts 45 and 46 having screw holes 5 formed at a predetermined interval. The cover plate 70 is made of a material having high heat resistance and low heat conductivity. The cover plate 70 also includes screw holes 5 formed at the upper and lower parts thereof at a predetermined interval.

The insulating member 42*a* comprises upper and lower flange parts 47 and 48 vertically extending from the upper and lower ends thereof. At the upper and lower flange parts 47 and 48 are formed screw holes 5 at a predetermined interval. Consequently, the upper and lower flange parts 47 and 48 of the insulating member 42*a* correspond to the upper and lower flange parts 45 and 46 of the supporting member 43, respectively.

The supporting member 43, in which the insulating member 42*a* is fitted, is placed at the inside of the left side plate 13, and the cover plate 70 is placed at the outside of the left side plate 13. In this state, screws 6 are threadedly engaged into the screw holes 5 such that the supporting member 43 and the cover plate 70 are securely attached to the inside and the outside of the left side plate 13 while the supporting member 43 is not brought into contact with the left side plate 13 by the upper and lower flange parts 47 and 48 of the insulating member 42*a*.

If the supporting member 43 is not brought into contact with the left side plate 13 as described above, the supporting member 43 may be made of a metal material, and heat transfer between the first and second cooking spaces 10*a* and 10*b* along the left side plate 13 is prevented by the insulating member 42*a*.

The insulating unit 40*a* is also mounted at the right side plate 14 of the cooking chamber 10 in the same manner.

Figure 7:
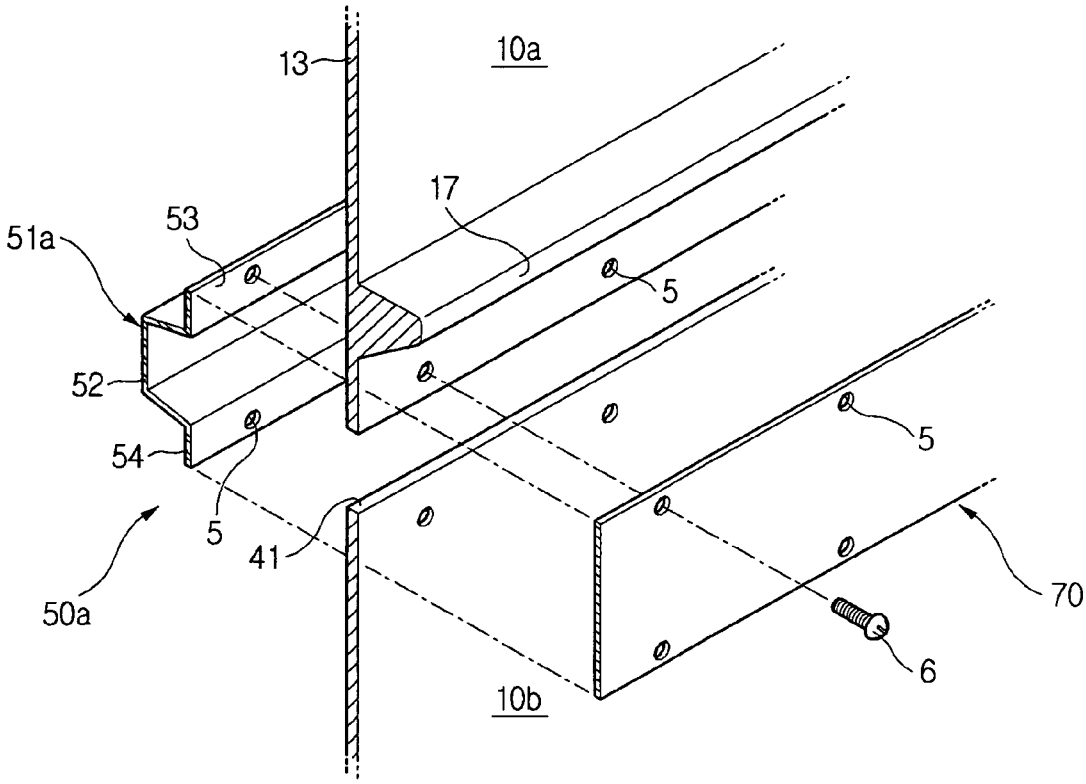
FIG. 7 is an exploded perspective view illustrating a cooling unit mounted at the left side plate of the cooking chamber in accordance with yet another embodiment of the present invention.

FIG. 7 is an exploded perspective view illustrating a cooling unit 50*a* mounted at the left side plate 13 of the cooking chamber 10 in accordance with yet another embodiment of the present invention. As shown in FIG. 7, no insulating unit is mounted at the left side plate 13 of the cooking chamber 10, and therefore, heat transfer between the first and second cooking spaces 10*a* and 10*b* along the left side plate 13 of the cooking chamber 10 is maximally prevented only by the cooling unit 50*a*.

The cooling unit 50*a* comprises an air guide member 51*a* attached to the outside of the left side plate 13 such that an air passage is defined between the air guide member 51*a* and the slit 41, a cover plate 70 attached to an inside of the left side plate 13 to cover the slit 41, and a blowing fan 60 (see FIG. 5) connected to the air guide member 51*a* through the connection duct 61. The air guide member 51*a* and the cover plate 70 are made of a material having high heat resistance and low heat conductivity.

The air guide member 51*a* comprises a channel part 52 protruded outward from the left side plate 13 such that the air passage is defined between the channel part 52 and the slit 41, and upper and lower flange parts 53 and 54 integrally formed with the channel part 52 while extending from the upper and lower ends of the channel part 52, respectively, such that the upper and lower flange parts 53 and 54 are attached to the outside of the left side plate 13.

At the upper and lower flange parts 53 and 54 of the air guide member 51*a* are formed screw holes 5 at a predetermined interval. Also, the cover plate 70 comprises screw holes 5 formed at the upper and lower parts thereof at a predetermined interval.

The air guide member 51*a* and the cover plate 70 are placed at the outside and inside of the left side plate 13 such that the screw holes 5 of the air guide member 51*a* are aligned with the screw holes 5 of the cover plate 70, respectively. Screws 6 are threadedly engaged into the screw holes 5, and the air guide member 51*a* is connected to the blowing fan 60 through the connection duct 61, to thereby assembly the cooling unit 50*a*.

When the blowing fan 60 is operated, air forcibly flows through the connection duct 61 and the channel part 52. As a result, the left side plate 13 adjacent to the slit 41 is cooled, and therefore, heat transfer between the first and second cooking spaces 10*a* and 10*b* along the left side plate 13 is maximally prevented.

It should be noted that the cooling unit 50*a* is also mounted at the right side plate 14 of the cooking chamber 10 in the same manner.

As apparent from the above description, the present invention provides an oven that is capable of preventing heat transfer from one cooking space having relatively high temperature to another cooking space having relatively low temperature along opposite side plates of a cooking chamber having a plurality of vertically partitioned cooking spaces. Consequently, heat loss is maximally prevented, and food is cooked in the optimum cooking condition in the respective cooking spaces.

Furthermore, cooking space(s) where food is not cooked is maintained at relatively low temperature, and therefore, the temperature of the door corresponding to the cooking space(s) where the food is not cooked is not increased. Consequently, a user is not in danger when the user touches the door corresponding to the cooking space(s) where the food is not cooked, and therefore, the user can easily and conveniently hold a grip of the door.

Although a few embodiment of the present invention have been shown and described, it would be appreciated by those skilled in the art that changes may be made in this embodiment without departing from the principles and spirit of the invention, the scope of which is defined in the claims and their equivalents.

What is claimed is:

1. An oven comprising:

a cooking chamber to cook food therein;

a partition horizontally disposed in the cooking chamber to partition the cooking chamber into first and second cooking spaces; and an insulating unit mounted at each side plate of the cooking chamber to prevent heat transfer between the first and second cooking spaces along each side plate of the cooking chamber.

2. The oven according to claim 1, wherein the insulating unit comprises:

a slit of a predetermined width, formed along each side plate of the cooking chamber under the partition;

an insulating member fitted in the slit to prevent heat transfer along each side plate; and a supporting member attached to an inside of each side plate to support the insulating member.

3. The oven according to claim 2, wherein the supporting member comprises:

a receiving part to receive the insulating member; and upper and lower flange parts vertically extending from the upper and lower ends of the receiving part, respectively, such that the upper and lower flange parts are attached to each side plate of the cooking chamber.

4. The oven according to claim 3, wherein the insulating member comprises upper and lower flange parts vertically extending from the upper and lower ends thereof, respectively, wherein the upper and lower flange parts of the insulating member are attached to each side plate of the cooking chamber along with the upper and lower flange parts of the supporting member.

5. The oven according to claim 2, further comprising:

a cooling unit mounted at an outside of each side plate of the cooking chamber to cool the insulating member.

6. The oven according to claim 5, wherein the cooling unit comprises:

an air guide member attached to the outside of each side plate of the cooking chamber to cover the insulating member; and a blowing fan connected to the air guide member to forcibly blow outside air to the air guide member.

7. The oven according to claim 6, wherein the air guide member comprises:

a channel part forming an air passage; and upper and lower flange parts vertically extending from the upper and lower ends of the channel part, respectively, such that the upper and lower flange parts are attached to the outside of each side plate.

8. The oven according to claim 7, wherein the channel part comprises a plurality of pushing protrusions to push the insulating member to the supporting member such that the insulating member is prevented from being moved in the receiving part of the supporting member.

9. The oven according to claim 6, wherein the blowing fan is mounted on top of the cooking chamber at the outside of the cooking chamber, and the air guide member includes one end thereof connected to the blowing fan through a connection duct such that air blown by the blowing fan is supplied to the air guide member.

10. The oven according to claim 6, wherein the supporting member and the air guide member each comprise a material having high heat resistance and low heat conductivity.

11. An oven comprising:

a cooking chamber to cook food therein;

a partition horizontally disposed in the cooking chamber to partition the cooking chamber into first and second cooking spaces; and a cooling unit mounted at each side plate of the cooking chamber to minimize heat transfer between the first and second cooking spaces along each side plate of the cooking chamber.

12. The oven according to claim 11, wherein each side plate comprises a slit of a predetermined width, formed along each side plate under the partition; and each cooling unit comprises an air guide member to cover the slit at the outside of each side plate, a cover plate to cover the slit at the inside of each side plate, a blowing fan mounted on top of the cooking chamber at the outside of the cooking chamber to forcibly blow outside air to the air guide member, and a connection duct connected between the blowing fan and the air guide member.

13. The oven according to claim 12, wherein the air guide member comprises:

a channel part forming an air passage; and upper and lower flange parts vertically extending from the upper and lower ends of the channel part, respectively, such that the upper and lower flange parts are attached to the outside of each side plate.

14. The oven according to claim 2, further comprising: a cover plate to cover the slit at an outside of the each side plate.

15. An oven comprising:

a cooking chamber having side plates and a plurality of cooking spaces to cook food therein;

a partition horizontally disposed in the cooking chamber to partition the plurality of cooking spaces; and a cooling unit mounted at an outside of each side plate of the cooking chamber to prevent heat transfer between the cooking spaces along the side plates.

16. The oven according to claim 15, further comprising a slit of a predetermined width, formed along each side plate of the cooking chamber under the partition.

17. The oven according to claim 16, wherein each cooling unit comprises:

an air guide member attached to an outside of each side plate of the cooking chamber, such that an air passage is defined between the air guide member and the slit;

a cover plate attached to an inside of each side plate to cover the slit; and a blowing fan connected with the air guide member via a connection duct, to forcibly blow outside air into the air guide member, to cool each side plate adjacent to the slit, and to prevent heat transfer between the cooking spaces along each side plate.

* * * * *